US010737522B2

(12) United States Patent
King et al.

(10) Patent No.: US 10,737,522 B2
(45) Date of Patent: Aug. 11, 2020

(54) PROCESS FOR PRODUCING A PRINTING SURFACE

(71) Applicant: Commonwealth Scientific and Industrial Research Organisation, Campbell, Australian Capital Territory (AU)

(72) Inventors: Peter Christopher King, Ashwood (AU); Mahnaz Zehtab Jahedi, Toorak (AU); Justin Patrick Holland, Mount Eliza (AU); Yu He Shi, Mount Waverly (AU); Alexander Carl Engel, Wheelers Hill (AU)

(73) Assignee: KINETIC ELEMENTS PTY LTD., Greensborough Vic (AU)

( * ) Notice: Subject to any disclaimer, the term of this patent is extended or adjusted under 35 U.S.C. 154(b) by 672 days.

(21) Appl. No.: 14/376,184

(22) PCT Filed: Feb. 8, 2013

(86) PCT No.: PCT/AU2013/000114
§ 371 (c)(1),
(2) Date: Aug. 1, 2014

(87) PCT Pub. No.: WO2013/116907
PCT Pub. Date: Aug. 15, 2013

(65) Prior Publication Data

US 2015/0010733 A1 Jan. 8, 2015

(30) Foreign Application Priority Data

Feb. 9, 2012 (AU) ..... 2012900479

(51) Int. Cl.
*B41N 7/00* (2006.01)
*B41N 7/06* (2006.01)
(Continued)

(52) U.S. Cl.
CPC ..... *B41N 7/005* (2013.01); *B41N 7/06* (2013.01); *C23C 8/02* (2013.01); *C23C 8/24* (2013.01);
(Continued)

(58) Field of Classification Search
CPC ..... C22F 1/183; B41N 7/06; B41N 7/005; C23C 8/24
(Continued)

(56) References Cited

U.S. PATENT DOCUMENTS 4,566,938 A 1/1986 Jenkins et al.
5,093,180 A * 3/1992 Morgan ..... B41C 1/05 101/217
(Continued)

FOREIGN PATENT DOCUMENTS

DE 3714327 11/1988
EP 0396114 7/1994
(Continued)

*Primary Examiner* — Weiping Zhu
(74) *Attorney, Agent, or Firm* — Tarolli, Sundheim, Covell & Tummino LLP

(57) ABSTRACT

A process for producing a fluid transfer surface, which process comprises: providing a titanium or titanium alloy surface; subjecting the titanium or titanium alloy surface to surface hardening by interstitial element absorption to provide a hardened surface; and, if required engraving the hardened surface to provide a desired surface topography.

12 Claims, 4 Drawing Sheets

(51) Int. Cl.

| | |
|---|---|
| ***C23C 8/24*** | (2006.01) |
| ***C23C 8/34*** | (2006.01) |
| ***C23C 8/80*** | (2006.01) |
| ***C23C 8/02*** | (2006.01) |
| ***C23C 24/04*** | (2006.01) |
| ***D21H 23/58*** | (2006.01) |

(52) U.S. Cl.
CPC ..... *C23C 8/34* (2013.01); *C23C 8/80* (2013.01); *C23C 24/04* (2013.01); *D21H 23/58* (2013.01); *B41N 2207/02* (2013.01); *B41N 2207/10* (2013.01); *Y10T 29/49746* (2015.01); *Y10T 29/49995* (2015.01); *Y10T 428/24479* (2015.01)

(58) Field of Classification Search
USPC ..... 148/512
See application file for complete search history.

(56) References Cited

U.S. PATENT DOCUMENTS

| | | | | |
|---|---|---|---|---|
| 5,302,414 | A | 4/1994 | Alkhimov et al. | |
| 5,792,289 | A * | 8/1998 | Morton ..... | C22F 1/183 148/237 |
| 6,267,825 | B1 | 7/2001 | Stall et al. | |
| 2006/0093736 | A1 * | 5/2006 | Raybould ..... | C23C 24/04 427/180 |

FOREIGN PATENT DOCUMENTS

| | | |
|---|---|---|
| EP | 0722510 | 5/1999 |
| EP | 1968795 | 6/2007 |
| WO | 2009109016 | 9/2009 |

* cited by examiner

PROCESS FOR PRODUCING A PRINTING SURFACE

TECHNICAL FIELD

The present invention relates to the production of a fluid transfer surface, to a fluid transfer surface so produced, and to use of the fluid transfer surface.

BACKGROUND TO THE INVENTION

In a fluid transfer operation, a surface loaded with fluid (a fluid transfer surface) is in constant or repeated contact against a secondary surface, for example a printing plate, blanket cylinder, rubber roller or a target substrate surface on to which the fluid is to be applied. The fluid transfer surface usually has a precisely engineered topography which must remain unaltered over its lifetime. The surface must also be capable of repeatedly receiving and transferring a consistent and uniform quantity of fluid, and hence must be hard and wear resistant. Any damage to the surface caused by gradual wear in service or careless handling is likely to translate to defects on the intended product.

Another issue to note is that fluids to be applied to a secondary surface can be highly corrosive. Flexographic inks, for example, are typically alkaline and they sometimes contain a high content of ammonia, which will attack metals such as copper and aluminium. Furthermore, modern printing inks are complex formulations loaded with particulate filler materials, such as clay and calcium carbonate and mineral pigments, and such fillers may contribute to wear of softer printing surfaces, such as printing rolls and/or doctor blade surfaces.

Chromium electroplating (or "hard chrome") has been used to protect (roller) surfaces against wear and corrosion by deposition of a chromium layer over the surface. However, this has its drawbacks. The deposited chromium layer includes pinpoint porosity and thus does not provide an entirely effective barrier to corrosive printing fluids. This necessitates the use of a more dense barrier film, such as nickel, deposited on the relevant surface as an undercoat before deposition of the chromium layer. Furthermore, chromium plating entails environmental and health hazards. Plating baths use chromic acid which presents an acute hazard. However, of even more concern is that plating involves the use of the hexavalent form of chromium ($Cr^{6+}$) which is a human carcinogen. Spent solution must also be dealt with carefully to its high acid content and loading with heavy metals.

Since the 1970s plasma spraying of a thick layer of chromium oxide has somewhat superseded chromium electroplating as a means of imparting wear and corrosion resistance to a fluid transfer surface. Chromium oxide is extremely hard (HV~1500) and more wear resistant than chromium plating. Following plasma spraying the surface of the chromium oxide is machined and then engraved with a uniform pattern of cells or grooves by a laser.

However, this approach is itself not without problems. The deposition efficiency of conventional air plasma spray of chromium oxide powder is relatively low (less than about 45%) and plasma spraying entails large power requirements, both of which mean that the cost of running a plasma spray system is relatively high. Furthermore, structural defects are always present in plasma sprayed coatings and porosity tends to be high. As will be appreciated, defects in the coating reduce its effectiveness as a barrier to corrosive fluids. When corrosive fluids come in contact with the underlying substrate, failure at the coating-substrate interface commonly occurs. Also, high levels porosity may restrict the cell count that can be engraved, which limits the quality of printing that can be produced.

There have also been concerns about the possibility of $Cr^{6+}$ formation from thermal spraying of chromium-based powders. Indeed, in 2004 the State of California Air Resources Board passed Resolution 04-44 which stated that thermal spraying operations that use materials containing chromium may result in potentially harmful airborne concentrations of hexavalent chromium and set out control measures to address this risk.

Against this background it would be desirable to provide an alternative approach for producing fluid transfer surfaces, for example printing surfaces, that are hard, that are wear resistant and that are resistant to corrosion by fluids that will come into contact with the surface during use.

SUMMARY OF THE INVENTION

Accordingly, the present invention provides a process for producing a fluid transfer surface, which process comprises:

providing a titanium or titanium alloy surface;

subjecting the titanium or titanium alloy surface to surface hardening by interstitial element absorption to provide a hardened surface; and, if required, engraving the surface to provide a desired surface topography.

In relation to the engraving step, if this is required it may be carried out before and/or after the step in which the titanium/titanium alloy surface is subjected to surface hardening.

Titanium and titanium alloys have outstanding resistance to atmospheric corrosion and attack by aggressive solutions, including alkaline media. The density of titanium is 4.5 $g/cm^3$ and in the current context this makes it an attractive choice for large dies and press rolls, where excessive weight makes handling cumbersome. However, titanium and titanium alloys tend to have poor tribiological properties, rendering them unsuitable for situations where surfaces slide against each other, such as for fluid transfer surfaces.

The present invention seeks to leverage off the desirable properties of titanium and titanium alloys whilst addressing the issue of their poor wear resistance. In accordance with the invention this is done by processing the titanium or titanium alloy to effect surface hardening. In accordance with the invention this is achieved by a mechanism of interstitial element absorption.

The present invention also provides a fluid transfer surface produced by the method of the invention, and to the use of such a surface in a fluid transfer process. The invention further provides a method of providing a fluid on a secondary surface, which method comprises providing a fluid to be transferred on a fluid transfer surface in accordance with the present invention, and contacting the fluid transfer surface with the secondary surface to transfer the fluid from the fluid transfer surface to the secondary surface. Herein the term "secondary surface" is used to denote the surface on to which fluid is to be transferred. The secondary surface may be a surface that is itself used to transfer the fluid on to a final product/substrate surface, for example a printing plate, blanket cylinder or roller. Rollers are typically formed of a natural or synthetic polymer, usually rubber, or a metal. Alternatively, the secondary surface may be a final product/substrate per se on to which the fluid is to be applied. Examples of final product/substrates include plastics films and sheets (e.g. PE, PET, PP, BOPP, vinyl, PVC, polycarbonate, polystyrene, Nylon and PTFE) and metallised films. The films may be cast or blown films or a laminate. Alternatively, the final product/substrate may be a paper sheet or roll, timber or a metal sheet or metal foil. The present invention may have particular utility in relation to the production of surfaces for fluid transfer in the context of a printing operation.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

BRIEF DISCUSSION OF THE FIGURES

Embodiments of the present invention are illustrated with reference to the accompanying non-limiting drawings.

DETAILED DISCUSSION OF THE INVENTION

Figure 1:
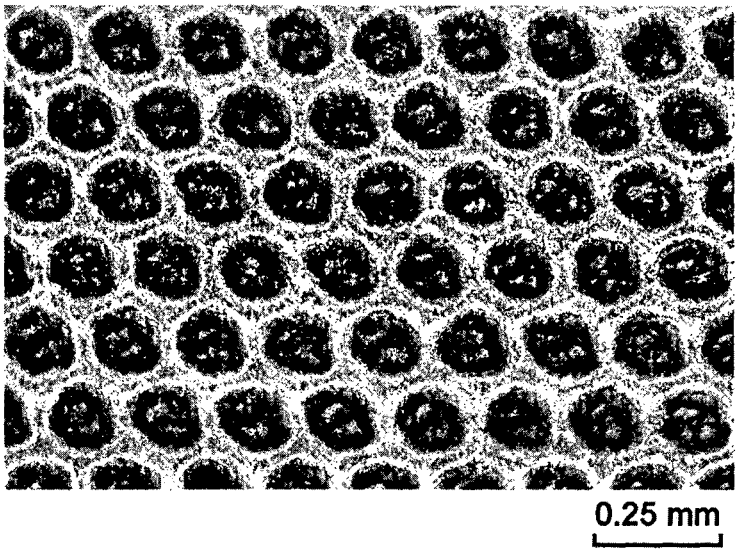
FIG. 1 is an optical microscope image of a titanium surface produced in accordance with the invention as described in Example 1.

In accordance with the present invention the wear resistance and surface hardness of a titanium or a titanium alloy surface are increased by enriching the surface (or one or more regions of the surface) with one or more interstitial elements that react with titanium and that give rise to desirable surface properties. It is also possible that the element will react with an alloying metal when a titanium alloy is used, especially with alloying elements such as aluminium, vanadium and chromium, for example. Typically, the interstitial element is selected from one or more of nitrogen, oxygen, carbon and hydrogen. The required surface hardening may be achieved by localised melting of the surface in the presence of a gas including the relevant element(s). This, aspect of the invention may also be regarded as a melt hardening step. However, in another embodiment, it may be possible to achieve the desired surface hardening without localised melting of the surface of the titanium/titanium alloy surface. This embodiment involves solid state hardening and may 1.5 be achieved by exposing the surface to be treated to an appropriate heat source and a gas containing the relevant interstitial element(s). Typically, the surface hardness achieved using the invention should be at least HK 800 (Knoop hardness under 10 g load) and preferably at least HK 1200. The gas used may be pure or a mixture of gases. In another embodiment the gas used to provide the interstitial element(s) may be provided as a mixture with an inert gas.

As gas, pure nitrogen (possibly diluted with an inert gas such as argon or helium) may be used. Nitrogen can be absorbed into the heated titanium/titanium alloy surface and upon cooling forms a microstructure including titanium nitrides and/or a solid solution of nitrogen in the metallic titanium lattice. This process is known as nitriding.

Likewise, certain gases containing oxygen or carbon in the treatment environment allow uptake of these elements by the surface being treated. Air for instance, being rich in both nitrogen and oxygen may be used to cause an oxynitriding reaction to occur. Carbonaceous gases such as CO or $CO_2$ may be used to achieve carburising. The general result is a surface microstructure in which N, C, O and/or H is/are dissolved interstitially in the titanium lattice and titanium nitride, carbide, oxide, hydride and/or mixed (eg. oxynitride) phases.

In an embodiment of the invention surface hardening may be undertaken in a series of stages with the gas environment being changed between stages to achieve interstitial hardening by absorption of more than one element.

In another embodiment the gas used may be varied depending upon the particular region of the surface being treated. In this case the composition and thus the surface hardening effect may vary over the surface.

Additionally, or alternatively, the surface hardening effect may be manipulated over the surface being treated by varying the intensity with which the surface is heated and/or the duration of heating. These process parameters will also influence interstitial element absorption, as well as the gaseous environment used.

Varying process variables such as the gas used, the intensity/type of heating and/or the duration of heating may also be applied to achieve differential elemental absorption and thus differential properties at different locations on a surface, as might be desired. For example, it may be desired to achieve a different surface hardening effect over different areas of a substrate based on the wear characteristics of those regions when the surface is used for fluid transfer. In this case, areas of the surface that will be subjected to greater wear may be treated to provide increased surface hardness when compared with areas on that same surface that will be subjected to reduced wear.

The surface hardness characteristics of a surface, or regions of a surface, may also influence the effectiveness of fluid transfer to a secondary surface, and the present invention may allow optimization of fluid transfer properties by manipulating process parameters as described.

The titanium or titanium alloy substrate surface may be a fluid transfer component itself, such as a printing plate or cylinder, or the titanium/titanium alloy may be provided as a surface coating or layer or sleeve over another material or component to provide a fluid transfer component. In either case, the component will be of conventional design and may take the form of a cylinder (i.e. it may be a roll or roller), plate etc. The component may be produced by conventional techniques such as casting, rolling, extruding, drilling and welding.

In another embodiment of the invention a titanium or a titanium alloy layer surface is provided (directly) on an underlying material (component) by cold spray (also known as cold gas-dynamic spray). The layer formed by cold spraying may then be processed in accordance with the present invention. Cold spray is a solid state deposition process described, for example, in U.S. Pat. No. 5,302,414. In the process powder particles are accelerated within a supersonic stream of gas so that upon impact against a work piece surface they deform and bond. The accelerating gas is typically nitrogen, helium or air, or a mixture of two or more of these. Particles are accelerated to velocities of about 300 to about 1,200 metres per second. The process takes place at relatively low temperature so that in-flight melting of the particles being sprayed does not occur. In the context of the present invention cold spray may be used to deposit a thin (typically less than 3 mm, for example in the range from 0.1-1.5 mm) but dense layer of titanium or titanium alloy onto a material (component). The layer of titanium or titanium alloy is typically provided directly onto the material. In this way titanium or a titanium alloy may be cold sprayed as a coating onto the surface of a base component such as a cylinder, plate or die. The component may be made of any suitable supporting material, including ferrous alloys such as steel and cast iron, aluminium alloys, polymer-based composites (e.g. glass fibre or carbon fibre in a polymeric matrix), or any combination of these. If a thick enough titanium/titanium alloy layer is deposited it may then be machined to bring the overall dimensions of the component back to within tolerances and to remove the rough, as-sprayed surface. The average roughness (Ra) generally ought to be less than 0.5 micron prior to engraving, although this figure is also dependent on the fineness of the engravings. In some cases however, this additional machining step may not be required. The titanium/titanium alloy coating is then subjected to surface hardening and possibly engraving using the methodology of the present invention. Cost benefits associated with this approach may be that cheap component materials may be used, and the amount of titanium/titanium alloy used may be minimised.

In another embodiment cold spray may be used to provide a layer of titanium or titanium alloy on a pre-existing fluid transfer surface that has become too worn or damaged to be fit for use. In this case cold spray may be used to provide a new layer of titanium/titanium alloy over the worn or damaged area(s) of the fluid transfer surface. Typically, the worn or damaged area will be machined back prior to cold spraying to provide a suitable surface so that cold sprayed particles will adhere to it. After titanium or titanium alloy has been deposited as required over the worn or damaged area the titanium or titanium alloy that has been deposited may be machined back as required, and then the newly applied surface subjected to processing in accordance with the present invention. The intention is that the area of repair will have the same surface properties (in terms of surface hardness and surface relief/patterning) as the original surface. Accordingly, the present invention also provides a method of repairing a fluid transfer surface, which comprises providing on the fluid transfer surface a layer of titanium or titanium alloy by cold spraying onto the surface titanium or titanium alloy particles and subjecting the titanium or titanium alloy layer to surface hardening by interstitial element absorption to provide a hardened surface and, if required, engraving the hardened surface to provide a desired surface topography. As noted it may be necessary to machine back the (original) fluid transfer surface prior to cold spraying and/or the deposited titanium or titanium alloy later prior to surface hardening.

In another embodiment it may be desired to change the surface features of a pre-existing fluid transfer surface and cold spray may be used to "overwrite" existing features with a fresh layer of titanium/titanium alloy. Typically, the original surface features may be removed by machining followed by cold spraying to provide a fresh layer of titanium or titanium alloy. In some cases machining may not be essential, although machining may give improved results in terms of adhesion of the layer applied by cold spraying. The fresh (cold sprayed) layer may then be machined back as necessary and then treated in accordance with the present invention to provide a fluid transfer surface having new surface features for fluid transfer. In a variation of this, instead of machining the original fluid transfer surface, cold spray may be used to fill fluid transfer features and build up a suitably thick layer of titanium or titanium alloy to enable a new fluid transfer surface to be made in accordance with the present invention. After deposition of titanium or titanium alloy by cold spraying the surface is usually machined back prior to hardening and engraving in accordance with the invention.

In another embodiment a titanium/titanium alloy component (e.g. cylinder, plate or other form) may be directly fabricated by cold spray. Direct fabrication or direct manufacture by cold spray involves converting a powder feedstock into a dense, cohesive free-standing component comprised of the particulate feedstock material only. This may be achieved by spraying the powder onto a mandrel or support, which is subsequently removed. The as-sprayed component is either at the dimensions required of the final product within tolerances or requires only minimal machining in order to reach the specified dimensions (see WO 2009/109016 "Manufacture of pipes").

In a further embodiment a titanium or titanium alloy layer may be provided on an underlying substrate by laser cladding. This technique is known in the art.

Various grades of titanium, and various types of titanium alloy, may be used, in the invention. In another embodiment the titanium or titanium alloy may be a composite material including one or more functionally effective additives. For example, the titanium or titanium alloy may include particles, such as nanoparticles, that provide increased wear resistance to the titanium or titanium alloy. Such particles may comprise boride, carbide or oxide compounds. The use of silicon carbide may be mentioned by way of illustration.

The functionally effective additive may be incorporated into the titanium or titanium alloy by known means. In this regard producing the use of cold spray may be a particularly convenient way to produce titanium/titanium alloy including such additives.

In another embodiment the titanium or titanium alloy may comprise a sacrificial component that will be vaporised or burned off by the heat applied during surface hardening. This will create porosity in and increased surface relief on the titanium/titanium alloy substrate. This may be desirable as it will increase the ability of the substrate surface to capture and retain fluid in a fluid transfer process. By way of example, the sacrificial material may be a polymer (used as particles). Cold spray may conveniently be used to produce a titanium/titanium alloy incorporating such a sacrificial component.

In the following, unless otherwise indicated, reference to titanium and titanium alloy is intended to embrace the various possibilities described above.

Heating of the titanium/titanium alloy surface to facilitate surface hardening may be achieved in a variety of ways. For example, the surface may be heated to an appropriate extent whilst being exposed to a gas including the relevant element(s). In an embodiment of the invention a surface to be treated may be sprayed with a plasma jet containing a mixture of an inert gas and a gas including the relevant element(s). The plasma jet is typically sprayed by means of a torch including an electrode to create a plasma. One skilled in the art would be familiar with this technique and how it is to be implemented.

Preferably, heating of the surface is limited to the area and thickness of titanium/titanium alloy that is to be surface hardened. Indeed, it may be undesirable to cause less localised heating, for example, if the titanium/titanium alloy is provided on a heat sensitive component, such as a polymer composite.

Accordingly, in a preferred embodiment of the invention melt hardening is performed using a laser to effect melting of the surface. In this case a laser may be used to provide very localised surface heating. When laser hardening is applied to an engraved surface the treatment conditions are usually controlled to limit the melt depth so that it does not exceed the depth of the engravings. Otherwise, excessive smoothing and distortion of the engraved structure may result. For example, a trihelical pattern with 80 lines per inch has a cell depth of about 50 micrometres and so surface melting during any subsequent laser hardening step is best limited to no more than 50 micrometres. Moreover, the use of laser surface hardening by interstitial element absorption has been found to be remarkably flexible, allowing a wide range of properties to be produced on the titanium/titanium alloy surface in a controllable manner. Thus, the surface may be tailored to suit the particular fluid transfer application. Generally, a gas or solid state laser may be used, for example a $CO_2$, Nd:YAG or Fibre laser, and one skilled in the art would be familiar with their operation. A variety of operating parameters may influence the surface hardening effect achieved in accordance with the present invention, and the influence of each and combinations of each may be explored by experiment. Broadly speaking, operating parameters relate to operation of the laser, relative movement of laser and surface, and gas supply.

With respect to the laser that is used, relevant operating parameters will depend upon the laser source used and its mode of operation. In pulse mode relevant operating parameters include laser pulse energy, pulse width, repetition rate and beam expanding telescope setting. In continuous mode, for example using a Nd:YAG laser, the relevant parameter is laser power. Different types of lasers may be manipulated to produce the same hardening or engraving effect by different choice of operation mode, optical elements, etc.

With respect to relative movement between laser and titanium/titanium alloy surface relevant parameters include traversing speed and overlapping ratio. The laser may be stationary and the titanium/titanium alloy surface moved relative to it, or vice versa.

With respect to gas supply, relevant parameters include gas concentration, gas flow rate and flow direction.

Generally, the depth of hardening depends on the thickness of the (surface) layer that is reactive with the relevant interstitial element(s) during heating of the titanium/titanium alloy surface. For example, when melt hardening at low laser energies, the melt depth will be relatively shallow. Peak hardness is related to the concentration of hard phases (such as nitrides and carbides) at the surface, and their composition. The hydrophilic nature of the surface may also be manipulated by reaction of the titanium/titanium alloy with the treatment gas.

When using a laser the roughness of the treated surface has been found to be a function of laser power, traverse speed, spacing between passes, and treatment atmosphere. In a nitrogen-rich atmosphere a characteristic rough, coral-like surface morphology has been found to be produced (see FIG. 4 below). Increasing the laser power results in a transition to a much smoother treated surface. On a machined titanium/titanium alloy surface roughness ($R_a$) values less than 0.3 μm are readily achievable following laser treatment.

In accordance with an embodiment of the present invention, it may be possible to produce a hardened surface that is suitable for fluid transfer without any need for an engraving step. In this case surface hardening may yield surface topography/relief that is immediately useful for fluid transfer so that engraving is not actually required. This may be the case where laser treatment results in a suitable degree of surface roughness, and this may be controlled by varying certain operating parameters as identified above. In particular the laser energy is believed to be relevant in this regard. Generally speaking, to be useful for fluid transfer the surface should have a surface volume capacity of from 1-300 $cc/m^2$, for example from 1-110 $cc/m^2$, such as from 2-20 $cc/m^2$, as determined by conventional techniques such as using a vertical scanning inferometer or stereo-video analysis. Generally, the mean roughness depth ($R_z$) should be less than 200 μm, for example from 5-100 μm, determined for example using a stylus profilometer.

In other embodiments the surface is processed (engraved) to provide a desired topography/surface relief based on the intended fluid transfer function, and this may be done using conventional techniques. These may be mechanical in nature, such as embossing or knurling. Alternatively, engraving may be carried out using chemical etching or laser engraving. Combinations of two or more of these techniques may also be employed.

Engraving can be done before and/or after the surface hardening aspect of the process has been carried out. Hardening may be performed before engraving or vice versa. It is possible that one or more regions will be engraved, with other regions not being engraved.

In a preferred embodiment of the invention a laser is used to engrave topographical features into the surface that are useful for the precise metering and transfer of fluids. Laser surface engraving is standard practice in the manufacture of fluid meter rolls, such as chromium oxide coated Anilox rolls. A common topography is a repeating pattern of identical hexagonal-shaped cells that form a honeycomb pattern over the surface (as shown in FIG. 1). Another common topography is a square pattern. Cell pattern morphology depends on the engraving angle which results from the combined linear movement of the laser and the roll rotation. Another topography that is often used in gravure printing rolls is continuous parallel grooves or channels, usually in a tri-helical arrangement.

It may be advantageous with respect to efficiency to use the same laser system for the hardening and engraving operations. As noted, hardening may be performed before engraving and/or after engraving. Two or more hardening passes may be required in order to produce sufficient wear resistance. Additionally, a laser may be used to prepare the surface prior to any hardening or engraving steps, and in this case the laser power will be selected accordingly. Thus, a processing regime may be envisaged whereby a raw titanium/titanium alloy surface is fully engineered by a series of laser operations to make it suitable to the task of fluid transfer.

This may be achieved by several different configurations of laser equipment as follows.

- A single laser beam controlled to perform different operations on the surface at different times. In this case operational parameters are set specifically for each individual type of operation.
- A single laser divided into multiple beams each beam delivering energy to different physical locations on a workpiece surface.
- A multi-beam system (generally two or more beams through a single lens).
- Multiple lasers. More than one type of laser may be needed due to differing requirements in the type of the laser-surface interaction required by the various surface operations. Different laser sources produce radiation at characteristic wavelengths. Furthermore, particular operational modes might be used to advantage, such as the extremely short pulses which are possible by Q-switching, mode locking or by other methods. These allow large quantities of energy to be delivered to the surface within an extremely short time interval. This may not be possible on all laser systems, however. Furthermore, each laser may deliver one or more beam to a workpiece surface.

With any one of the above laser arrangements, it is possible to perform multiple operations on each point of a workpiece surface by as follows.

- Discrete operations, separated in time. For example, in the case of a cylindrical workpiece, laser operations may be separated in time by each revolution of the cylinder. Alternatively, it may be advantageous to complete a processing step over the entire surface before commencement of the next.
- Multiple treatment zones, offset physically from each other. For example, hardening operations may be distributed before, during or after an engraving pulse.
- Any combination of the above. For example, in the case of a cylindrical workpiece, laser energy may be directed at multiple points, offset from each other circumferentially and/or axially, while multiple revolutions of the cylinder result in repetition of this treatment sequence.
- Multiple laser beams directed at the one location, operating in unison.

In one embodiment of the present invention a titanium or titanium alloy surface is subjected to treatment cycles comprising one or more engraving steps and one or more hardening steps (in any order). By way of example, this embodiment may comprise from 2 to 10 treatment cycles but not limited to 10 cycles.

There are many benefits to be gained by multiple treatment operations. For example, repeated engraving pulses, sometimes known as "multi-hit engraving" allow greatly improved uniformity of the cell structures, averaging of temporal laser power variations, averaging of temporal laser mode variations, and improved engraved structures. Performing the engraving and hardening operations simultaneously on a titanium surface has the advantage that cell walls may be hardened completely while the engraved structures are being formed. In this aspect of the invention higher treatment levels are often possible while retaining the engraved structures than would be possible from post-engraving treatment alone. In addition to the improved treatment levels further benefits of coincident treatment and engraving include, greater control over the finished structures, flexibility over choice of engraving parameters, reduced processing time, reduced waste, simplified processing and production of complex structures impossible to obtain by engraving before or after treatment.

In an embodiment of the invention the process may be at least partially automated. For example, surface hardening and engraving may be carried out sequentially using one or more suitably positioned lasers. For example, these may be arranged circumferentially around a cylindrical substrate having a titanium/titanium alloy surface that is to be hardened and engraved. It may also be possible to add a cold spray station "upstream" of the one or more lasers to provide a suitable titanium/titanium alloy surface to be treated. A surface produced by cold spraying may need machining prior to surface hardening and engraving but this may not be necessary depending upon the smoothness of the as-produced cold sprayed surface.

The invention further provides a method of providing a fluid on a secondary surface, which method comprises providing a fluid to be transferred on a fluid transfer surface in accordance with the present invention, and contacting the fluid transfer surface with the secondary surface to transfer the fluid from the fluid transfer surface to the secondary surface. To be useful and effective for fluid transfer as intended, the titanium/titanium alloy surface will include surface features/relief (cavities, depressions, channels, grooves etc) which are intended to allow a uniform volume of fluid to be metered onto the surface, and transferred from the surface onto a secondary surface when the surface/fluid is brought into contact with the secondary surface. The mechanism by which transfer of fluid from the fluid transfer surface to the secondary surface occurs is typically associated with surface tension.

There are numerous practical applications for surfaces prepared in accordance with the invention. As will be appreciated, the present invention may be used to provide titanium/titanium alloy rollers which may be used in place of conventional ceramic coated, chromium plated or metallic fluid transfer rollers. In the context of a flexographic printing press, the function of a fluid meter roll, known in this case as the Anilox roll, is to control the flow of ink from the ink reservoir to the printing plate. Flexography is a printing process that is used to print on a wide variety of substrates. These may be divided into narrow web and wide web applications. Narrow web includes tags and labels, envelopes and cartons. Wide web spans all manner of flexible packaging, including polyethylene, polypropylene, PET and cellophane. Wrappers and bags used in the food industry are a major market segment. Wide web also includes paper and newspapers.

There are many other industrial applications which require metering (and transfer) of precise quantities of fluids. For example, roll coating is used across a range of industries to apply uniform thin films of liquid to secondary surfaces, ranging from adhesive tape to vinyl wallpaper. Engraved cylinders are used to apply paint films to coils of steel or aluminium sheet. Gravure rolls in the laminating industry operate in the same manner to the flexographic Anilox roll: they meter a quantity of liquid which is controlled by the cell count, configuration and the volumetric carrying capacity of each cell. In this case, the term gravure roll should not be confused with the gravure roll used in rotogravure (intaglio) printing, which has an engraved image that is replicated on the substrate when the roll comes into contact with it. Anilox rollers are also used in the manufacture of the alignment layer in liquid crystal displays (LCD), laser hologram labels and forgery protection labels.

It will be appreciated that in the context of the present invention the term "fluid" is not limited to liquids. Indeed, in some of the applications mentioned, inks and paints contain a high solids content. Thus, the term may also extend to slurries and, possibly (flowable) powders, such as polymer powders and metal oxide powders (e.g., $TiO_2$). Further examples of fluids that it may be desired to apply to a secondary surface include hot melt liquids, such as resin adhesives and sealants, adhesives such as polyvinyl acetate (PVA), polyvinyl chloride (PVC) and urethanes, pigments, food products and food ingredients, such as starch, and biomedical reagents.

The fluid being transferred may contain particles which impart functionality to the printed surface. One example is magnetic ink character recognition (MICR) which employs ferromagnetic oxide pigments to provide security features to cheques used in banking. Another area where the invention may find utility is in the manufacture of flexible electronic devices, whereby a relatively thick film with suitable electrical or electromagnetic properties is applied to a flexible secondary surface. The film may contain particles of a conductive material such as silver or a silver alloy. One common example is radio frequency identification (RFID) tags. Other new applications may require high resolution printing on a large scale, such as organic light-emitting diodes (OLEDs) for flexible displays and organic thin-film transistors (OTFTs). In the developing area of organic or polymeric solar cells, the adoption of roll-to-roll printing techniques may be instrumental in the scale up from laboratory trials to full-scale production. In this regard the fluid may be a slurry of $TiO_2$ powder provided in a suitable carrier such as an alcohol. After transfer of slurry on a secondary surface the alcohol may be evaporated to provide a deposit of $TiO_2$.

The main advantages of the present invention include:

- Resistance to corrosion and other chemical attack due to the use of titanium and titanium alloys.
- Avoidance of chromium-containing materials that pose a threat to the environment and to human health.
- Potential simplification and enhanced efficiency of the manufacturing process by using a laser for the hardening and engraving processes.
- Potential process control. For example, critical properties of a surface such as roughness, surface energy and hardness may be controlled by manipulation of the laser treatment parameters.
- Repairability of the treated titanium surface. Worn or damaged areas may be rebuilt using additive techniques such as cold spray, and the rebuilt material then engraved and hardened. This is a considerable saving in time and effort compared with current ceramic-coated rollers, for instance, which require the entire coated surface to be stripped back to the roller base, and the coating reapplied.

Embodiments of the present invention are illustrated with reference to the following non-limiting examples.

EXAMPLE 1

The following example serves to demonstrate the use of a laser to perform engraving and hardening operations on a titanium surface. For this purpose 0.4 mm-thick grade 2 titanium sheet was obtained from a commercial supplier. The physical form of titanium was chosen for ease of analysis post-treatment, although there is no reason why the same sequence of processing steps could not be applied to any other shape or size of workpiece.

The sheet was wrapped around a 75 mm-diameter cylinder and rotated so that the circumferential surface speed was 0.25 m/s. A Nd:YAG laser was used to engrave and nitride the surface in three separate steps. For engraving the laser was operated in Q-switched TEM00 mode. $N_2$ was injected through the laser nozzle head into the work area during engraving. A screen angle of 60° was used to produce an hexagonal cell pattern. For hardening the multi-mode TEM 11 was employed. In the first hardening step $N_2$ gas was also used so as the nitride the surface. Following this, the surface was retreated without $N_2$ gas injection, so that the heated surface was exposed to ambient air and as a result, oxynitrided.

An optical microscope image of the surface following the final oxynitriding treatment stage is provided in FIG. 1. The cell measurements were taken using a Rollscope Interferometer. The measured screen count was 142 lines per inch. The average cell depth was 54.86 μm.

The sheet was then cross-sectioned, mounted in epoxy resin and polished using standard metallographic techniques. The microhardness at various locations within the treated surface was determined using a Knoop indenter under a 10 g load. The microhardness at the very tips of the cell walls was found to reach values within the range HK 1800-2100. The microhardness very deep (at least 200 μm) below the surface in the unaffected area of the substrate was HK 176±2.

Figure 2:
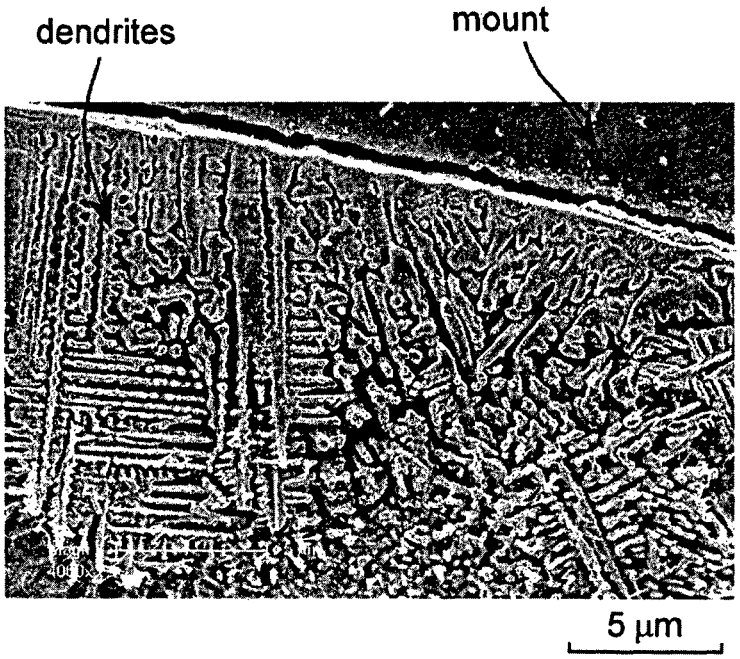
FIG. 2 is a scanning electron microscope image of an etched cross-section of a titanium surface produced in accordance with the invention as described in Example 1.

The polished cross-section was then etched using Kroll's reagent (hydrofluoric and nitric acid solution in water). A representative scanning electron microscope image of the treatment zone microstructure is shown in FIG. 2. Cubic dendrites of titanium nitride were found at the surface, particularly within cell walls. The dendrites were indicative of oxynitride formation during solidification of an oxygen- and nitrogen-rich titanium melt. Most of the hardening measured by Knoop indentation was associated with this part of the microstructure. Following the two-stage hardening treatment the dendrites were found to be particularly closely spaced, which further improved the micro-hardness readings obtained. Deeper into the surface a complex series of other microstructures was normally found, including hexagonal titanium dendrites, acicular titanium martensite and polygonal grains of titanium in the parts of the substrate that were too deep to be affected by laser heating.

EXAMPLE 2

The following example shows the adaptability of the method described in this invention to the production of various surface textures on titanium.

The same 0.4 mm grade 2 titanium sheet material was used as in the previous example. It was fixed onto a cylinder in an identical manner and rotated so that the surface speed was 0.25 cm/s. Engraving was performed using the Nd:YAG laser in Q-switched TEM00 mode. The laser was programmed to engrave a pattern consisting of two sets of straight grooves at a 45° angle to the cylinder axis. One set of grooves was spaced at regular 170 μm intervals, while the second, oriented perpendicular to the first, was spaced at regular 350 μm intervals. In combination, the two sets of grooves defined 170×350 μm rectangles, shown in FIG. 3. Cross-sectional analysis showed that the depth of the grooves was ~30 μm.

Figure 3:
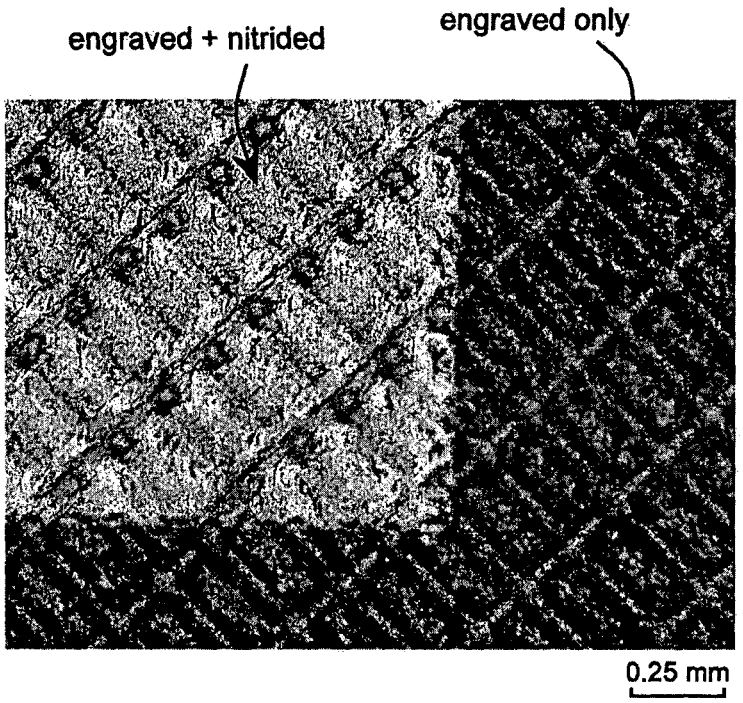
FIG. 3 is an optical microscope image of a titanium surface produced in accordance with the invention as described in Example 2.

Following engraving the surface was nitrided using the laser on multi-mode TEM11 with the beam focussed on the workpiece. FIG. 3 is an optical microscope image showing, in the top-left, the edge of an area that had been engraved and nitrided and the surrounding area that was engraved but not nitrided. A range of laser power settings was trialled for laser nitriding. FIG. 3 shows the effect with the laser attenuated to approximately 52 W constant wattage. The grooved structure was clearly retained following nitriding. To the naked eye, the top-left area of FIG. 3 had turned a lustrous, gold colour. With different laser nitriding settings, and in particular with the introduction of different gases into the treatment area, a wide range of different colours and degrees of reflectivity could also be produced.

The sheet was then cross-sectioned, mounted in epoxy resin and polished using standard metallographic techniques. The Knoop microhardness under a 10 g load was found to reach values within the range HK 1400-1600 closest to the surface.

EXAMPLE 3

This example demonstrates that with correct choice of laser treatment conditions a titanium surface may be melted in a single operation which hardens the surface and produces a topology with micrometre-scale raised features and depressions.

A section of grade 2 titanium cylinder, 75 mm in diameter and 3 mm wall thickness, was chosen for the experiment. It was treated using a Nd:YAG laser, operated under multimode TEM11, and attenuated to approximately 33W constant wattage. In order to broaden the spot size on the workpiece the laser was underfocused by 1.0 mm±0.1 mm from the surface. During treatment $N_2$ gas was injected into the work zone. The cylinder was rotated to achieve a linear surface speed of 0.25 m/s, and the laser nozzle moved axially at a constant 0.02 mm per revolution.

Figure 4:
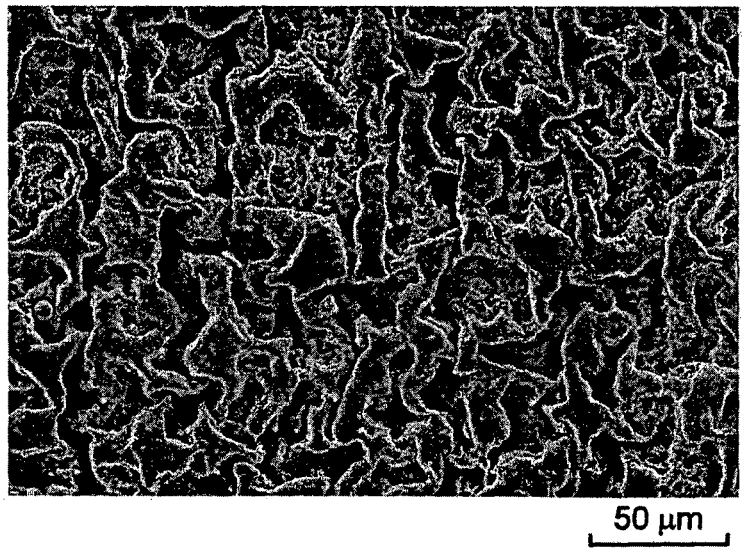
FIG. 4 is a scanning electron microscope image of a titanium surface produced in accordance with the invention as described in Example 3.

FIG. 4 shows a scanning electron microscope image of the treated surface, which displayed a coral-like morphology. Deep depressions are present which allow the surface to hold more fluid than a comparatively smoother surface. The mean roughness depth ($R_z$), determined using a stylus profilometer, was 13.9±0.9 μm.

The sample was cross-sectioned, mounted and polished for microhardness profiling. A Knoop indentor was used with a 10 g load applied load. At the tips of the asperities the microhardness reached 1000-1200 HK, which indicated effective hardening by laser nitriding.

EXAMPLE 4

This example demonstrates a multipass treatment in which a series of alternating laser engraving and laser hardening steps are used.

The same 0.4 mm grade 2 titanium sheet material was used as in Examples 1 and 2. It was fixed onto a cylinder in an identical manner and rotated so that the surface speed was 0.25 cm/s. Using the Nd:YAG laser the following 6 treatment passes were executed.

Pass 1: Engraving in Q-switched TEM00 mode. Focus −2.0 mm (above target surface).

Pass 2: Hardening in CW TEM11 mode. Focus +0.5 mm (below target surface).

Pass 3: Engraving in Q-switched TEM00 mode. Focus −2.0 mm (above target surface).

Pass 4: Hardening in CW TEM11 mode. Focus +0.5 mm (below target surface).

Pass 5: Engraving in Q-switched TEM00 mode. Focus −1.0 mm (above target surface).

Pass 6: Hardening in CW TEM11 mode. Focus +0.5 mm (below target surface).

Nitrogen gas was injected around the work area for both engraving and hardening. The engraved pattern was a 60° hexagonal structure with a screen count of 225 lines per inch.

Figure 5:
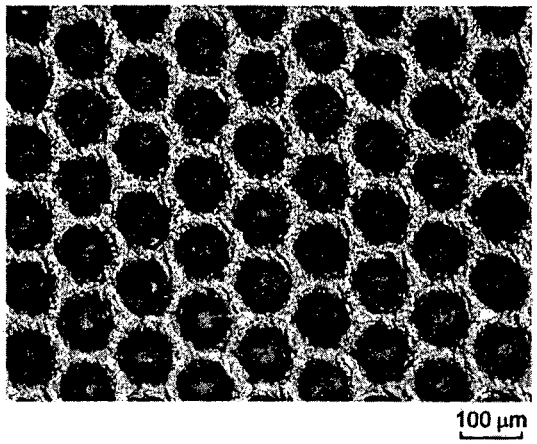
FIG. 5 is an optical microscope image of a titanium surface produced in accordance with the invention as described in Example 4.

FIG. 5 is an optical microscope image showing the resulting surface.

EXAMPLE 5

In the following example laser engraving and hardening was performed on a cold sprayed cermet composite coating.

Silicon carbide (SiC) powder was mixed with titanium powder to make a 25 wt. % SiC+75 wt. % titanium mixture. The titanium powder particles had an angular morphology and an average particle size of 24.9 μm. The SiC particles were also angular and the SiC powder was sieved to −25 μm. The mixture was then cold sprayed using a CGT Kinetiks 4000 system. Cold spray was performed using nitrogen as the carrier gas, with gas conditions of 3.5 MPa pressure and 800° C. immediately upstream from the nozzle. A CGT 24TC nozzle was used, which had an expansion ratio of 5.6 and diverging section length of 129.5 mm. A coating was deposited onto a mild steel cylindrical substrate with 75 mm outer diameter and 3 mm wall thickness. The cylinder was rotated on a lathe. The cold spray gun was controlled by an ABB robot. The gun was held perpendicular to the substrate surface with the end of the nozzle at a constant 30 mm standoff distance from the substrate, while it was moved down the length of the cylinder and back 33 times in order to build up the coating. A 1.2 mm thick coating resulted, which contained SiC particles in a metallic titanium matrix.

The coated cylinder was then machined back to a uniform diameter of 77.1 mm. Laser engraving and hardening was performed using the Nd:YAG laser, with the cylinder rotated at a circumferential surface speed of 0.25 m/s. The coated surface was first engraved with the laser in Q-switched TEM 00 mode and $N_2$ gas injected into the work area. An 80 lines per inch trihelical pattern oriented 45° to the cylinder axis was produced. An area of this surface was then hardened using the Nd:YAG laser on continuous wave (CW) TEM11 mode with $N_2$ gas injection. After hardening under nitrogen the surface turned a golden colour.

Figure 6:
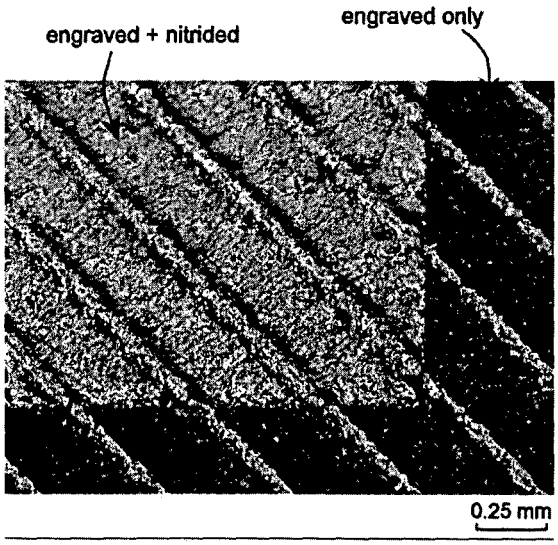
FIG. 6 is an optical microscope image of a titanium surface produced in accordance with the invention as described in Example 5.

FIG. 6 shows an optical microscope image of the engraved surface, and in the top left of FIG. 6, the hardened area. The sample was then sectioned, mounted in epoxy resin and polished. Knoop microhardness measurements of the polished cross-section showed that the peak hardness in the cell walls lay in the range 1600-2000 HK, indicating effective laser hardening.

EXAMPLE 6

This example demonstrates the manufacture of an anilox roller for a flexographic printing press using the methodology of the present invention.

A mild steel roller base had a total length of 579 mm including the journals at either end. The cylindrical working surface (roller face) was 69.0 mm in diameter and 350 mm long. A coating of titanium was deposited on the roller face using a CGT Kinetiks 4000 cold spray system. The feedstock material was the same angular titanium powder with 24.9 μm average particle size, used in example 5. The cold spray system was run with nitrogen gas at 3.5 MPa and heated to 800° C. at the entry point to the CGT 24TC converging-diverging nozzle. The as-sprayed coating thickness was 0.9 mm. The coating was machined to bring the total roller diameter back to 70.7 mm.

The machined coating surface was engraved with the Nd:YAG laser to make a trihelical pattern consisting of grooves aligned 45° to the roller axis and with a screen count of 150 lines per inch. For engraving the laser was operated in Q-switched TEM00 mode, with $N_2$ gas injected through the laser nozzle head into the work area. The engraved surface was then hardened by remelting the surface with the laser on continuous wave (CW) TEM11 mode with $N_2$ gas injection. Finally, the engraved and hardened surface was lapped using diamond-impregnated film. This lapping operation is a common technique used on anliox rollers to polish back the highest peaks, and so reducing wear of other surfaces in contact with the roller during normal press service.

Figure 7:
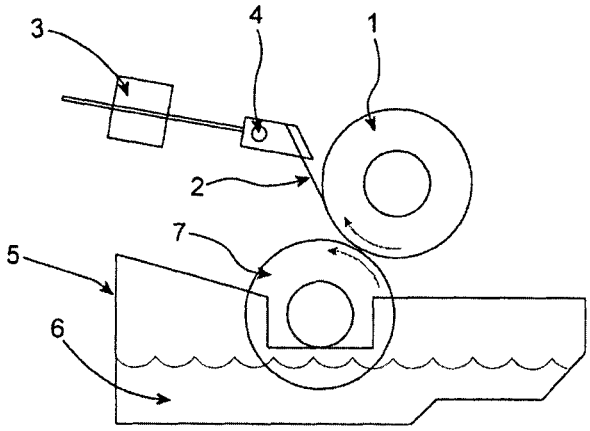
FIG. 7 is a schematic illustrating the arrangement of an ink pan, rollers and doctor blade assembly in printing press trials, as referred to in Example 6.

Wear testing of the roller was performed in a RY320-5B flexographic printing press (purchased from Hexiang, China). The a side view of the experimental setup is illustrated in FIG. 7. The roller 1 was run in the press at a printing speed of 60 metres per minute. A 350 mm-long white carbon steel doctor blade (0.2 mm lamella) 2 was in constant contact against the anilox roller in reverse angle configuration. Two 259 g weights 3 attached to rods at 60 mm from the blade holder pivot axis 4 were used to keep the doctor blade edge under constant force against the anilox roller 1 surface. From a worn blade edge the blade contact angle was determined to be 30°. No plate cylinder, impression cylinder or paper feed were used, as the object of the test was not to print, but to assess the wear resistance of the roller 1. As flexographic inks are prone to evaporation, and due to the need to provide constant conditions for the whole test duration, the ink tray 5 was filled with a mixture 6 of 1 part Flexoclean detergent, 10 parts tap water, instead of ink. The detergent solution 6 was picked up from the ink tray 5 by a 70.5 mm-diameter rubber fountain roller 7 and passed to the titanium-coated anilox 1. The rubber roller 7 and anilox 1 surfaces were not contacting, but close enough for the detergent solution 6 to wet the anilox roller 1. Excess solution was wiped from the titanium-coated anilox 1 by the doctor blade 2. The titanium coated roller 1 was run in this manner for a total of 224 hours, which equated to 807.84 km of travel. Interferometer analysis of the surface topology following the test showed no change in the trihelical dimensions.

By comparison, an unhardened cold sprayed roller under identical conditions wore considerably after only 40.00 km (11.1 hours), with the complete disappearance of cells over areas of the surface.

EXAMPLE 7

Figure 8:
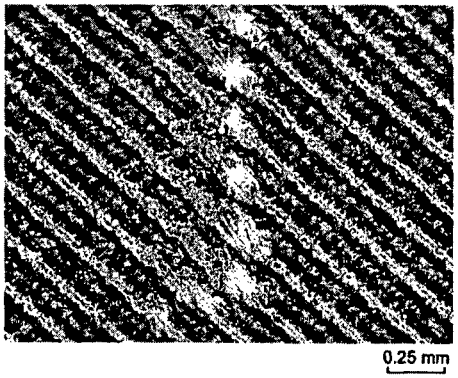
FIG. 8 is an optical microscope image of a damaged area on a titanium surface produced in accordance with the invention as described in Example 7.

The following short procedure demonstrates the repairability of the roller. The optical micrograph in. FIG. 8 shows an area of the surface that was dented by impact by a heavy steel object. The trihelical pattern was visibly damaged. A 30 mm band of the roller surface around the damaged area was machined back and re-sprayed with the same titanium powder using the CGT Kinetiks system with the same 24TC nozzle, and $N_2$ gas preheated to 800° C. at 3.0 MPa. The re-cold sprayed area was machined and laser treated using an identical procedure to the original treatment. The roller was rotated to produce a circumferential surface speed of 0.25 m/s. Engraving of a trihelical pattern at 45° to the roller axis was performed with the Nd:YAG laser in Q-switched TEM00 mode, with $N_2$ gas injected into the work area. For nitriding, CW TEM11 mode was used, with $N_2$ gas injection. The resprayed coating did not show any sign of delamination during laser treatment. Cell measurements of the repaired surface were taken using a Rollscope Interferometer. The measured screen count was 150 lines per inch.

The invention claimed is:

1. A process for producing a printing surface or an anilox roll surface, which process comprises:

providing a titanium surface on a base component by cold spraying titanium onto the substrate;

forming the printing surface or the anilox roll surface by:

(a) subjecting the titanium surface to surface hardening by interstitial element absorption of any one or more interstitial elements selected from nitrogen, oxygen, carbon and hydrogen, wherein the surface hardening includes heating of the titanium surface by localised melting of the surface by a laser in the presence of a gas including the one or more selected interstitial elements and the heating is limited to the area and thickness of titanium that is to be surface hardened to provide a hardened surface, the fluid transfer surface having an engineered topography that is capable of receiving and transferring a consistent and uniform quantity of fluid; and (b) engraving the titanium surface to provide a desired surface topography and wherein the titanium surface is engraved using a laser, engraved by embossing or knurling, or by chemical etching; and wherein, in operation, the printing surface or the anilox roll surface at least one of constantly and repeatedly transfers fluid onto a secondary surface.

2. The process of claim 1, wherein the gas including the one or more interstitial elements element is used as a mixture with an inert gas.

3. The process of claim 1, wherein the gas is one of nitrogen, carbon dioxide or air.

4. The process of claim 1, wherein the titanium or surface is the outer surface of a cylinder.

5. The process of claim 1, wherein the base component is a cylinder, plate or die.

6. The process of claim 1, wherein the titanium or surface is a composite material comprising one or more functionally effective additives.

7. The process of claim 1, wherein the titanium or surface is subjected to treatment cycles comprising one or more engraving steps and one or more hardening steps, in any order.

8. The process of claim 7, wherein the titanium surface is subject to 2 to 10 treatment cycles.

9. The process of claim 1, wherein engraving the titanium surface includes selecting a desired surface topography that has a surface volume capacity in the range of 1 to 300 $cc/m^2$.

10. The process of claim 1, wherein engraving the titanium surface includes selecting a desired surface topography that has a surface volume capacity in the range of 1 to 110 $cc/m^2$.

11. The process of claim 1, wherein engraving the titanium surface includes selecting a desired surface topography that has a surface volume capacity in the range of 2 to 20 $cc/m^2$.

12. The process of claim 1, wherein the hardening and the engraving steps are performed simultaneously.

* * * * *